US007252074B2

(12) United States Patent
Chapman et al.

(10) Patent No.: US 7,252,074 B2
(45) Date of Patent: Aug. 7, 2007

(54) ADVANCE ARRANGEMENTS

(75) Inventors: Leslie Chapman, Chatham (GB); Rodney Dyason, Chatham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/496,642

(22) Filed: Jul. 31, 2006

(65) Prior Publication Data

US 2007/0023013 A1 Feb. 1, 2007

(30) Foreign Application Priority Data

Aug. 1, 2005 (EP) ..... 05254814

(51) Int. Cl.
*F02M 37/04* (2006.01)
*F02M 37/06* (2006.01)

(52) U.S. Cl. ..... 123/502; 123/450

(58) Field of Classification Search ..... 123/502, 123/446, 450, 500, 501, 503, 179.16, 179.17
See application file for complete search history.

(56) References Cited

U.S. PATENT DOCUMENTS 3,869,226 A 3/1975 Sosnowski
4,526,154 A 7/1985 DiDomenico
6,041,759 A * 3/2000 Burborough ..... 123/501
6,941,932 B2 * 9/2005 Hopley et al. ..... 123/502
2004/0084029 A1 5/2004 Hopley et al.

FOREIGN PATENT DOCUMENTS

EP 0657638 6/1995

* cited by examiner

*Primary Examiner*—Mahmoud Gimie
(74) *Attorney, Agent, or Firm*—David P. Wood

(57) ABSTRACT

An advance arrangement for controlling timing of fuel delivery by a fuel pump in an engine comprises an advance piston which is movable in either an advance or a retard direction to advance or retard, respectively, the timing of fuel pump delivery, wherein a surface associated with the advance piston is exposed to fuel pressure within a main advance control chamber. The advance piston has a supply port to allow fuel to flow into the main advance control chamber and a drain port to allow fuel to flow out of the main advance control chamber. A servo piston is movable relative to the advance piston to control opening and closing of the supply port and the drain port. The advance arrangement is characterised by a restricted flow means for restricting the flow of fuel out of the main advance control chamber through the drain port when the advance piston moves in the retard direction beyond a predetermined amount.

21 Claims, 3 Drawing Sheets

ADVANCE ARRANGEMENTS

FIELD OF THE INVENTION

The invention relates to an advance arrangement for use in controlling the timing of fuel delivery by a high pressure fuel pump intended for use in a compression ignition internal combustion engine.

BACKGROUND TO THE INVENTION

In a conventional rotary fuel pump, the angular position of a cam ring is adjusted by means of a servo advance arrangement. One known type of servo advance arrangement is described in our co-pending European patent application EP 1356196. The servo advance arrangement includes a main piston (referred to as the advance piston) which cooperates with a cam arrangement of the fuel pump to adjust the timing of fuel pump delivery. The advance piston is responsive to fuel pressure changes within an advance piston control chamber (the main advance control chamber). If pressure in the main advance control chamber increases, the advance piston is caused to move in a first direction so as to advance the timing of fuel delivery. If pressure in the main advance control chamber is reduced, the advance piston is caused to move in an opposite direction to retard the timing of fuel delivery.

A servo piston is operable in response to a transfer pressure signal (a signal dependent upon engine speed) to determine the position of the main advance piston. For certain positions of the servo piston, the main advance control chamber receives fuel at transfer pressure by means of a supply port provided in the advance piston and a flat machined on the outer surface of the advance piston. In such circumstances increased fuel pressure within the main advance control chamber causes the advance piston to move to advance engine timing. For other positions of the servo piston, a drain port is uncovered causing pressure within the main advance control chamber to decrease and, hence, the advance piston is moved to retard engine timing. The supply port and the drain port are aligned on a common axis on the advance piston so that both communicate with the flat, either to provide a flow route into the main advance control chamber through the supply port or a flow route out of the main advance control chamber through the drain port. The servo advance arrangement is also provided with a light load mechanism to permit the timing of fuel delivery by the pump to be varied when the engine operates under light load conditions.

In use, on sudden opening and closing of the throttle, the advance piston is caused to move rapidly between a no-load position and a full-load position (timing retardation), and then in a reverse direction between the full-load and no-load positions (timing advance). During advance, movement between the full-load and the no-load positions is rapid. Advance piston movement is also rapid during retardation between the no-load and full-load positions, although slightly less so compared with advance movement.

It has been observed that for certain applications the rapid movement of the advance piston during retardation results in a transient emission of undesirable white smoke. It is an object of the present invention to provide an improvement to the advance arrangement which removes or alleviates this problem.

SUMMARY OF THE INVENTION

According to a first aspect of the invention, there is provided an advance arrangement for controlling timing of fuel delivery by a fuel pump in an engine, the advance arrangement including an advance piston which movable in either an advance or a retard direction to advance or retard, respectively, the timing of fuel pump delivery. A surface associated with the advance piston is exposed to fuel pressure within a main advance control chamber. The advance piston has a supply port to allow fuel to flow into the main advance control chamber and a drain port to allow fuel to flow out of the main advance control chamber. A servo piston is movable relative to the advance piston to control opening and closing of both the supply port and the drain port as it moves in the retard and advance directions. The advance arrangement includes a restricted flow means which serves to restrict the flow of fuel out of the main advance control chamber through the drain port when the drain port is opened by the servo piston and when the advance piston is caused to move in the retard direction beyond a predetermined amount.

In a preferred embodiment, the advance piston is movable within a first bore provided in a housing and the servo piston is movable within a second bore provided in the advance piston.

The invention provides the advantage that, after a predetermined amount of retardation of the advance piston, during which period it tracks movement of the servo piston, the rate of retardation of the advance piston is slowed relative to the servo piston due to the flow of fuel out of the main advance control chamber being restricted. Thus, once the advance piston has moved beyond the predetermined amount the servo piston is retarded more rapidly than the advance piston. By way of example, the predetermined amount is about 5 degrees of retardation of the advance piston.

Slowing of the advance piston in the aforementioned manner has been found to reduce or remove the undesirable white smoke that has been observed in known arrangements, which arise due to engine timing being transiently too retarded on sudden application of a load (e.g. when rapidly moving from no to full load).

It may be an end of the advance piston itself that is exposed to fuel pressure within the main advance control chamber or, alternatively, a surface of a component carried by the advance piston.

In a preferred embodiment, the servo piston is responsive to speed-dependent fuel pressure variations within a servo control chamber.

The advance arrangement may further comprise a light load arrangement which serves to adjust engine timing under light load conditions. Typically, for example, the light load arrangement includes a light load piston moveable relative to the advance piston against the action of a light load control spring in response to fuel pressure variations within a light load control chamber, wherein said fuel pressure variations are dependent upon engine load.

In a preferred embodiment, the flow route out of the main advance control chamber when the servo piston uncovers the drain port is defined by a first flat or groove formed on the advance piston and a second flat or groove formed in the first bore in the housing.

In a further preferred embodiment, the first and second flats overlap, and are in direct communication with one another, in circumstances in which the advance piston is retarded through less than the predetermined amount, thereby to define a substantially unrestricted flow route for fuel out of the main advance control chamber. The first and second flats are spaced apart so as not to communicate directly when the advance piston is retarded through more than the predetermined amount. The restricted flow means may take the form of a restricted clearance defined in the region of separation between the flats.

Preferably, the restricted clearance is defined between an outer surface of the advance piston and the surface of the first bore.

The flow route into the main advance control chamber when the servo piston uncovers the supply port is preferably defined, in part, by the first flat provided on the advance piston.

Preferably, the supply port is defined at one end of a first radially extending passage formed in the advance piston, the other end of the first radially extending passage being in communication with the first flat on the advance piston.

It is also preferable to define the drain port at one end of a second radially extending passage formed in the advance piston, the other end of the second radially extending passage being in communication with the second flat on the surface of the first bore in the housing.

The first and second radially extending passages are preferably located so that the supply and drain ports open into the second bore in the advance piston at angularly spaced locations. In other words, the first and second radially extending passages do not lie on a common axis. In this way, undesirable leakage of fuel from the main advance control chamber is reduced.

In a particularly preferred embodiment, the advance piston is cooperable with a cam arrangement of the fuel pump to advance or retard the timing of fuel delivery by the pump.

BRIEF DESCRIPTION OF THE DRAWINGS

The invention will further be described, by way of example only, with reference to the accompanying drawings, in which.

DETAILED DESCRIPTION OF THE PREFERRED EMBODIMENTS OF THE INVENTION

In general, a conventional rotary fuel pump includes a cam ring (not shown) which is angularly adjustable with respect to a pump housing. The cam ring includes a plurality of cam lobes and encircles part of a distributor member, including pumping plungers which are slidable within respective bores of the distributor member. Each of the pumping plungers has an associated shoe and roller arrangement, the rollers of which are engageable with the cam surface of the cam ring. In use, fuel is supplied to the bores of the distributor member by a transfer pump and a force due to fuel pressure within the bores serves to urge the plungers in a radially outward direction. The output pressure of the transfer pump (referred to as "transfer pressure") is controlled so as to be related to the speed of operation of the engine with which the pump is being used. Rotation of the distributor member relative to the cam ring causes the rollers to move relative to the cam ring, engagement between the rollers and the cam lobes thereby causing the plungers to be forced in a radially inward direction to pressurise fuel within the respective bore and causing fuel to be delivered by the pump at relatively high pressure. By altering the angular position of the cam ring by means of an advance arrangement, the timing at which fuel is delivered by the pump can be adjusted.

As will be described in further detail below, the advance arrangement includes a servo piston arrangement which is arranged to influence the degree of timing advance depending on the operating speed of the engine (referred to as "speed advance"). The advance arrangement also includes a light load arrangement, including a load sensing piston, which is arranged to influence the degree of timing advance depending on the load under which the engine is operating (often referred to as "light load advance"). Optionally, a temperature control valve is arranged to influence the degree of timing advance depending on the operating temperature of the engine (often referred to as "cold advance").

Figure 1:
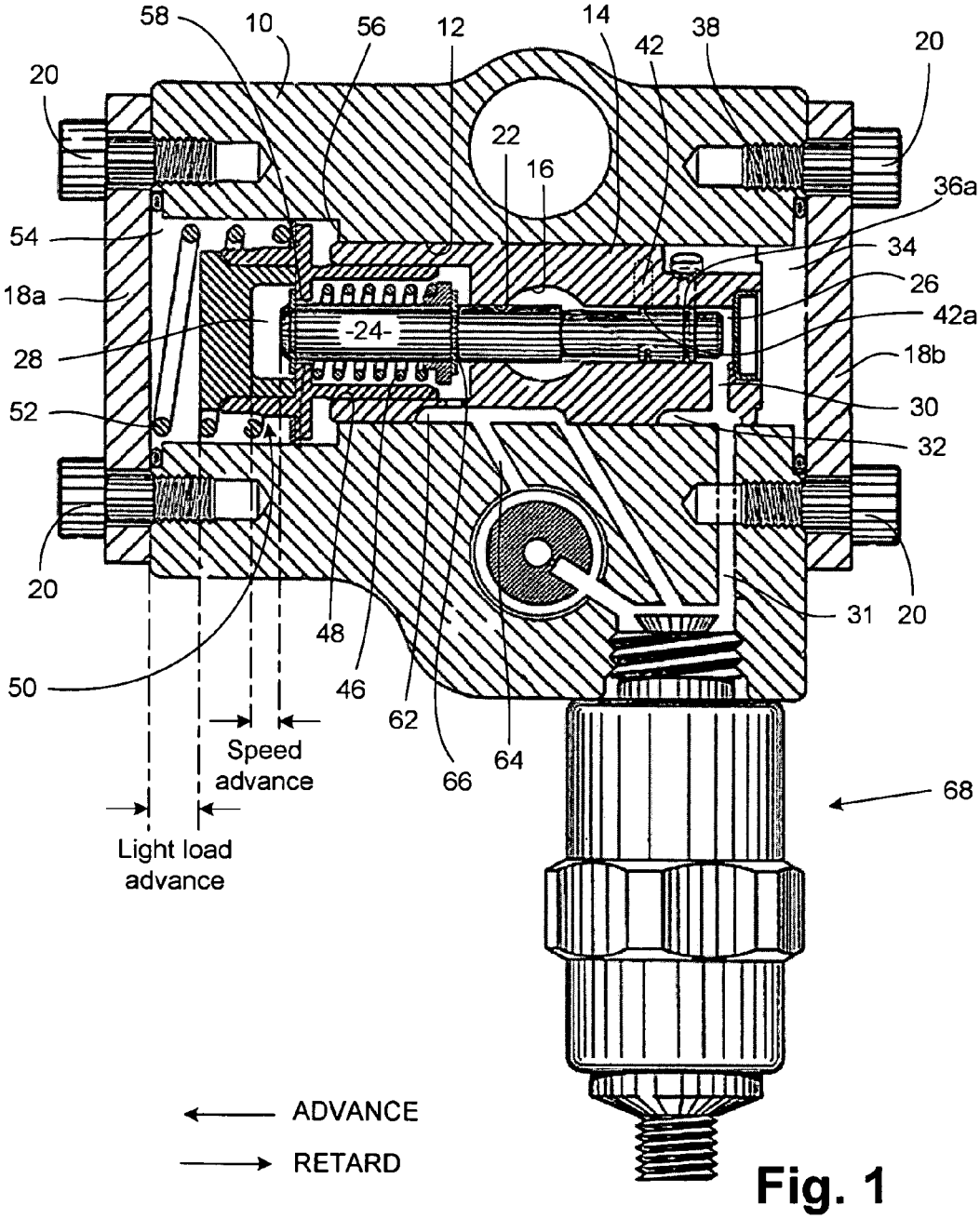
FIG. 1 is a cross sectional view of an advance arrangement of a first embodiment of the present invention.
Figure 2:
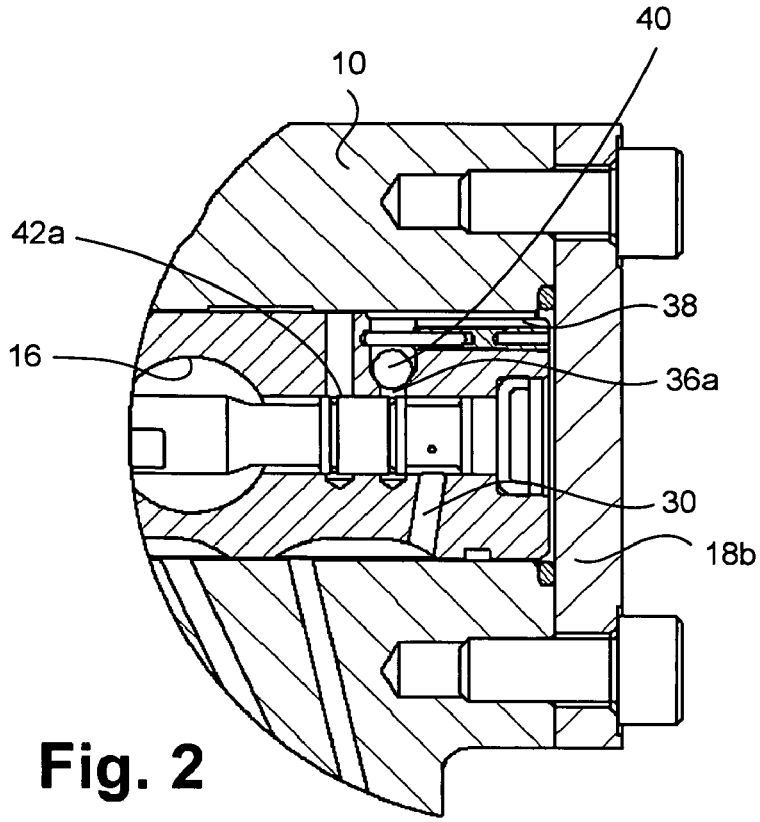
FIG. 2 is an enlarged view of a part of the advance arrangement in FIG. 1 to illustrate the supply and drain ports more clearly.

Referring to FIGS. 1 and 2, the advance arrangement includes an advance box housing 10 provided with a housing bore 12 within which an advance piston 14 is slidably received. Movement of the advance piston to the left is referred to as movement in the advance direction as it results in an advancement of engine timing, as will be apparent from the following description. Conversely, movement of the advance piston to the right is referred to as movement in the retard direction, as it results in retardation of engine timing.

The cam ring of the accompanying fuel pump is provided with a peg (not shown) which extends into an opening 16 provided in the advance piston 14 in order to permit adjustment of the angular position of the cam ring. The opening 16 communicates with the engine cam box and is therefore at low pressure. The ends of the housing bore 12 are closed by first and second end plates 18*a*, 18*b* (left and right hand end plates, respectively) which are secured to the advance box housing 10 by means of bolts 20.

The advance piston 14 is provided with a second bore 22 within which a servo piston 24 is slidably received. The servo piston 24 is exposed, at one end, to fuel pressure within a servo control chamber 26 and, at its other end, to fuel pressure within a second servo chamber 28. Fuel at transfer pressure is supplied to the servo control chamber 26, transfer pressure being dependent upon the speed at which the engine operates. Fuel is delivered to the second servo chamber 28 in dependence upon the load under which the engine operates.

The advance piston 14 is provided with a first radially extending passage 30 for delivering fuel to the servo control chamber 26. The supply passage 30 opens into a recess 32 provided in the outer surface of the advance piston 14, the recess 32 being positioned so that, for all permitted positions of the advance piston 14 relative to the advance box housing 10, it communicates with a main supply passage 31 in the advance box housing 14 through which fuel at transfer pressure is delivered.

A main advance piston control chamber 34 (referred to as the main advance control chamber) is defined at one end of the advance piston 14, bounded by the walls of the bore 12 and the right hand end plate 18*b*. A radially extending supply passage 36 provided in the advance piston 14 communicates with the main advance control chamber 34 by means of a channel or flat 38 formed on the outer surface of the advance piston 14. One end of the radially extending supply passage 36 defines a supply port 36*a* which is controlled by means of the servo piston 24. Thus, the radially extending supply passage 36 defines a means by which the main advance control chamber 34 communicates with the passages 30, 31 in the advance piston 14 when the supply port 36*a* is uncovered by the servo piston 24. As can be seen in FIG. 2, a non-return valve 40 is located within the supply passage 36, the function of which will be described in further detail below.

The advance piston 14 is also provided with a radially extending drain passage 42 which defines, at one end, a drain port 42*a* which opens into the bore 22 in the advance piston 14. The provision of the drain passage 42 permits the flow of fuel out of the main advance control chamber 34 to the opening 16 (i.e. cam box pressure) for certain positions of the servo piston 24. Both opening and closing of the supply port 36*a* and the drain port 42*a* are therefore controlled by means of the servo piston 24 depending upon its axial position relative to the advance piston bore 22. The drain passage 42 and the supply passage 36 are located at angularly spaced locations in the advance piston 14 so that they do not lie along a common axis.

Figure 3:
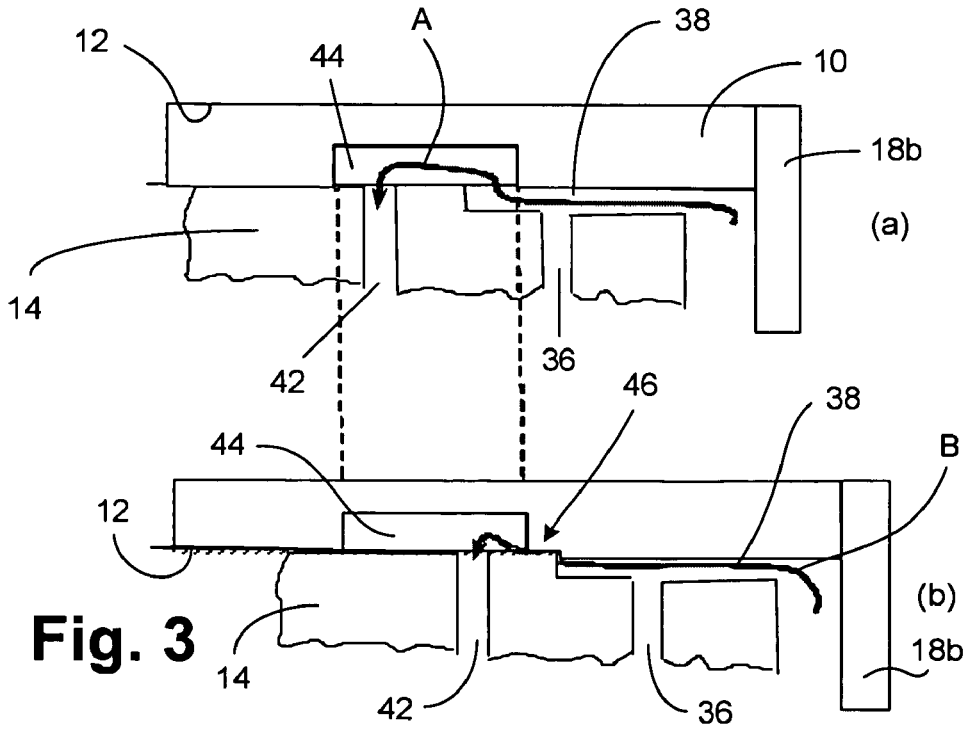
FIG. 3 is a schematic view of the supply and drain ports in FIG. 2 to illustrate flow paths therethrough, in use.

Referring to FIG. 3, in order to complete the flow route out of the main advance control chamber 34 when the drain port 42*a* is opened by the servo piston 24, the internal surface of the housing bore 12 is also provided with a second flat or groove 44 which communicates, for all positions of the advance piston 14, with the drain port 42*a*. The second flat 44 in the housing bore 12 is positioned so that, when the advance piston 14 is moved to the right beyond a predetermined position, a restricted flow means 46 is formed between the outer surface of the advance piston 14 and the internal surface of the housing bore 12 so that flow out of the main advance control chamber 34, via the flats 38, 44, is restricted. If the advance piston 14 has not moved so far to the right as to be positioned beyond the predetermined position, the first flat 38 overlaps, or is aligned with, the second flat 44 in the housing bore 12 so that there is an unrestricted flow path to drain.

Referring again to FIG. 1, at the end of the advance piston 14 remote from the main advance control chamber 34, the advance piston 14 defines an enlarged opening 48 into which one end of a light load piston 50 is received. The light load piston 50 is shown as being formed in two parts, although in practice a single-piece light load piston may be used. A light load control spring 52 is arranged within an end chamber 54 defined, in part, by the bore 12 in the advance box housing 10 and the left hand end plate 18*a*. The light load control spring 52 is engaged between the light load piston 50 and the left hand end plate 18*a* to bias the light load piston 50 into engagement with a step 56 defined by the housing bore 12. A blind bore is provided in the light load piston 50 to define the second chamber 28 within which the left hand end of the servo piston 24 is received. An annular clearance 58 is defined between an outer surface of the servo piston 24 and an inner surface of the light load piston 50 to permit communication between this second chamber 28 and a light load control chamber 60. The light load control chamber 60 receives a pressure signal in dependence upon engine load by means of an additional recess 62 provided in the outer surface of the advance piston 14. The additional recess 62 is arranged such that, for all permitted positions of the advance piston 14, the additional recess 62 communicates with a light load supply passage 64 defined in the housing 10.

A servo control spring 46 locates within the light load control chamber 60 so as to urge the servo piston 24 to the right in the illustration shown. It will be appreciated that a force due to fuel pressure within the servo control chamber 26, at the other end of the servo piston 24, serves to urge the piston 24 towards the left, countering the force of the servo control spring 46.

The pressure of fuel supplied through the light load supply passage 64 to the light load control chamber 60 is regulated by means of a metering valve arrangement (not shown), which therefore controls the position of the light load piston 50 relative to the advance piston 14. Fuel pressure within the light load control chamber 60 acts on the light load piston 50, to oppose the light load control spring 52, thereby to determine the relative axial positions of the light load piston 50 and the advance piston 14. As will be apparent from the following description, the position of the light load piston 50, being responsive to engine load, affects the relationship between engine speed and the rate of adjustment of timing of fuel delivery by the pump.

The maximum permitted movement of the servo piston 24 relative to the light load piston 50 occurs when an end surface of the servo piston 24 engages the end surface of the second chamber 28. The position of the light load piston 50 relative to the end plate 18*a* determines the maximum permitted level of advance. Movement of the servo piston 24 relative to the advance piston 14 in the retard direction is limited by engagement between an annular member 66 carried by the servo piston 24 and the end face of the opening 48 in the advance piston 14.

An electro-magnetically operated temperature control valve, referred to generally as 68, is mounted upon the housing 10 to control the supply of fuel through a cold advance supply passage. Details of the cold advance mechanism can be found in our co-pending European patent application EP 1356196 and will not be described in detail here.

There now follows a general description of the advance arrangement in FIGS. 1 to 3 to illustrate how engine timing is adjusted in response to speed and load variations.

In use, fuel delivered through the light load supply passage 64 to the light load control chamber 60 acts on the light load piston 50 to oppose the force due to the light load control spring 52. If pressure in the light load control chamber 60 is relatively low (e.g. a full load condition), the light load piston 50 is biased by means of the light load spring 52 into engagement with the step 56 in the bore 12. If fuel pressure in the light load control chamber 60 is relatively high (e.g. a low load condition), the light load piston 50 will be urged away from the step 56 to the left, with the effect that the advance characteristic is altered.

If the light load piston 50 is moved to the left under low engine load, the servo control spring 46 starts to unload. A point will be reached at which transfer pressure in the servo control chamber 26 acting on the other end of the servo piston 24 is sufficient to urge the servo piston 24 to the left also, thus causing the servo piston 24 to move together with the light load piston 50. The presence of high fuel pressure in the second chamber 28, by virtue of the annular clearance 58, prevents the servo piston 24 moving relative to the light load piston 50 in such circumstances.

Beyond a critical signal pressure into the light load control chamber 60, any variation in fuel pressure within the servo control chamber 26 due to a subsequent increase in transfer pressure (as a result of increased engine speed) will be insufficient to overcome the combined force of the servo control spring 46 and increased fuel pressure in the second chamber 28. Beyond this critical pressure (i.e. for lower loads) the servo piston 24 is therefore unresponsive to speed-dependent variations in fuel pressure within the servo control chamber 26 and, thus, the speed advance scheme of the arrangement is effectively disabled.

Changes in engine speed will also influence the pressure of fuel (transfer pressure) supplied to the servo control chamber 26, and hence to the main advance control chamber 34, so that the timing is advanced and retarded in dependence upon engine speed also (except under the low load condition described above). For a given engine load, for example, an increase in engine speed will result in an increase in fuel pressure within the servo control chamber 26, causing the servo piston 24 to move to the left (together with the light load piston 50) to open the supply port 36*a*. A decrease in engine speed will result in the servo piston moving to the right to close the supply port 36*a* and open the drain port 42*a*.

A more detailed description of operation of the light load and servo advance schemes can be found in our co-pending European patent application EP 1356196.

For the purpose of the following description it will be assumed that the engine is operating at a substantially fixed speed so that transfer pressure supplied to the servo control chamber 26 remains the same as the engine load condition changes.

With the servo piston 24 in the position shown in FIG. 1, the supply port 36*a* is closed by the outer surface of the servo piston 24 so that fuel delivered to the servo control chamber 26 is unable to flow through the supply passage 36 into the main advance control chamber 34. In the event that the servo piston 24 is moved to the left under the light load condition, the supply port 36*a* will be opened. In these circumstances, fuel flows from the servo control chamber 26, through the supply port 36*a* and past the non-return valve 40 (as shown in FIG. 2) into the main advance control chamber 34. The flow of fuel into the main advance control chamber 34 in such circumstances is substantially unrestricted.

The flow of fuel into the main advance control chamber 34 causes fuel pressure to increase, thereby applying a force to the advance piston 14 which causes the advance piston 14 to move towards the left (the advance direction), following movement of the servo piston 24. Movement of the advance piston 14 in the advance direction causes movement of the cam ring, due to the co-operation of the peg with the opening 16, and the timing of fuel delivery by the pump is advanced.

At the instant at which the rollers move into engagement with the cam lobes provided on the cam ring, a significant force is transmitted through the cam ring and the peg to the advance piston 14, tending to urge the advance piston towards the right in the orientation illustrated in FIG. 1. The provision of the non-return valve 40 in the supply passage 36 ensures that any such movement of the advance piston 14, which would otherwise tend to increase fuel pressure within the main advance control chamber 34, is avoided. By this means, a reverse flow of fuel into the servo control chamber 26 is prevented.

If the servo piston 24 is urged to the right in the event of an increase in engine load, communication between the servo control chamber 26 and the supply port 36*a* is broken. Once the servo piston 24 has moved sufficiently far to the right, the drain port 42*a* is opened to cam box pressure (i.e. low pressure) and fuel flows out of the main advance control chamber 34. As shown in FIG. 3(*a*), a flow route out of the main advance control chamber 34 is defined by the flat 38 on the advance piston 14, the flat 44 in the internal surface of the housing 10 and the open drain port 42*a*. As a result, pressure in the main advance control chamber 34 is decreased, with the result that the advance piston 14 is retarded. Movement of the advance piston 14 in the retard direction causes the timing of fuel delivery to be retarded.

In the present invention, the manner in which fuel flows out of the main advance control chamber 34 during retardation of the servo piston 24 and the main advance piston 12 is an important characteristic. Referring to FIG. 3(*a*), it can be seen that when the servo piston 24 has moved to the right by just a relatively small amount, the flat 38 on the advance piston 14 aligns with, or overlaps, the flat 44 on the internal surface of the housing bore 12 so that an unrestricted flow route (A) exists out of the main advance control chamber 34 to the drain port 42*a*. In such circumstances, retardation of the advance piston 14 is relatively rapid and substantially tracks movement of the servo piston 24. If the servo piston 24 is moved further to the right as the transfer pressure signal decreases further, as shown in FIG. 3(*b*), the flat 38 on the advance piston 14 no longer overlaps the flat 44 in the housing bore 12 (i.e. the flats 38, 44 become axially displaced) so that the clearance 46 between the outer diameter of the servo piston 24 and the internal bore surface defines a restricted flow route for fuel (B) out of the main advance control chamber 34. In such circumstances, the rate of pressure reduction in the main advance control chamber 34 is slowed so that the advance piston 14 no longer retards at the same rate as the servo piston 24. The rate of reduction in fuel pressure within the main advance control chamber 34 is determined by the flow rate through the restriction 46. Thus, the rate of retardation of the advance piston 14 is sensitive to the viscosity of fuel flowing out of the main advance control chamber 34.

Figure 4:
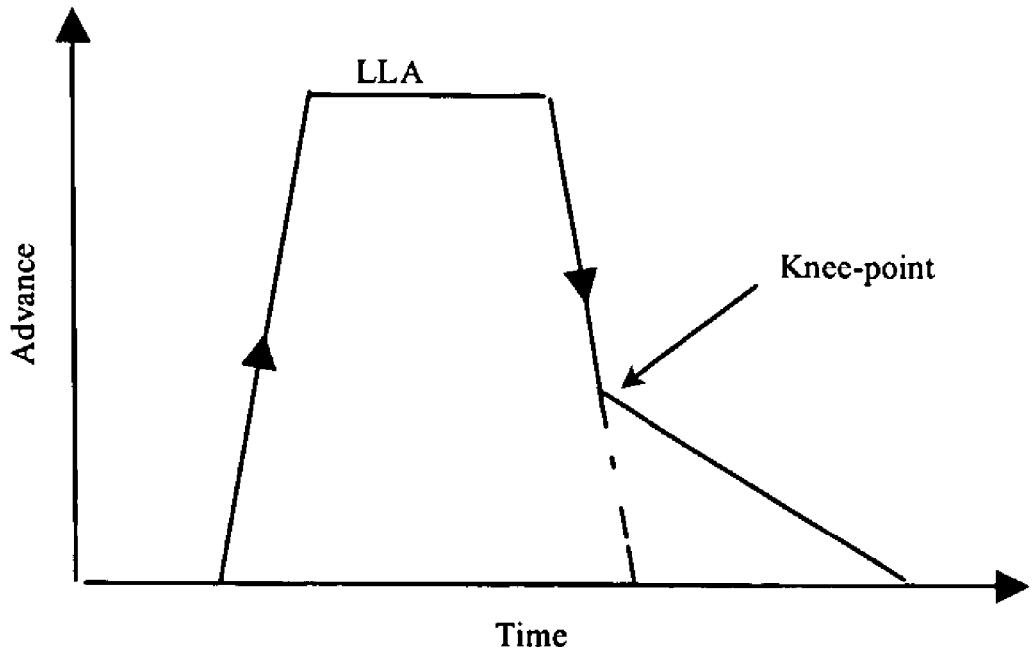
FIG. 4 illustrates an advance characteristic for the embodiment of the advance arrangement in FIGS. 1 to 3.

The aforementioned characteristic is illustrated in FIG. 4, where a so-called 'knee-point' of the advance characteristic is visible. Where the degree of retardation is less than the knee point, the advance piston 14 follows the characteristic of the known advance arrangement. Where the degree of retardation is greater than the knee point (as illustrated by a dashed line), the characteristic of the advance arrangement of the present invention deviates from that of the known advance arrangement. Typically, the knee point will occur at around 5 degrees of retardation of engine timing, or at least within the range of 4 to 8 degrees of retardation of engine timing.

It is this variability in the rate of movement of the advance piston 14 as it moves to retard engine timing that provides a particular benefit over the prior art. In particular, when the engine throttle is closed and the advance piston 14 is at full light load advance, on rapidly opening the throttle to give a full load condition both the servo piston 24 and the advance piston 14 start to retard quickly and together. Although the advance piston 14 moves quickly during the first part of retarding movement, when the advance piston 14 moves past the point at which the flat 38 on the advance piston 14 overlaps with the flat 44 in the housing bore 12, the response of the advance piston 12 is damped by the restricted flow out of the main advance control chamber 34 through the clearance 46. Problems with undesirable white smoke being emitted during retardation of the advance piston 14 under such circumstances are avoided by virtue of this slowing of the advance piston 14 for higher degrees of retardation.

In the embodiment shown, the drain port 42*a* and the supply port 36*a* are angularly offset from one another around the circumference of the advance piston 14 (i.e. not in line), and the supply passage 36 communicates only with the flat 38 on the advance piston 14. This differs from the known advance arrangement where the supply passage 36 and the drain passage 42 are in line with one another, both being in communication with the flat 38 on the advance piston 14 and with no restriction to flow out of the main advance control chamber 34. One further advantage of offsetting the supply passage 36 and the drain passage 42 is that the extraneous leakage path from the main advance control chamber 34, which could otherwise occur through a retaining pin hole for the non-return valve 40 in the supply passage 36, is avoided or substantially removed.

It will be appreciated that in some circumstances the servo piston 24 is also moved under speed advance, by virtue of changes in transfer pressure, and in this case the same restricted flow characteristic occurs for movement of the servo piston 24 beyond the knee point.

The advance arrangement of the present invention, whilst particularly suitable for use with a radial distributor type pump, may be applicable to other types of high pressure fuel pump also.

The invention claimed is:

1. An advance arrangement for controlling timing of fuel delivery by a fuel pump for use in an engine, the advance arrangement comprising;

an advance piston which is movable in either an advance or a retard direction to advance or retard, respectively, the timing of fuel pump delivery, a surface associated with the advance piston being exposed to fuel pressure within a main advance control chamber, the advance piston having a supply port to allow fuel to flow into the main advance control chamber and a drain port to allow fuel to flow out of the main advance control chamber, and a servo piston which is movable relative to the advance piston to control opening and closing of the supply port and the drain port, wherein the advance arrangement further includes a restricted flow path for restricting the flow of fuel out of the main advance control chamber through the drain port when the drain port is opened by the servo piston and the advance piston moves in the retard direction beyond a predetermined amount.

2. The advance arrangement as claimed in claim 1, wherein the advance piston is movable within a first bore provided in a housing and the servo piston is movable within a second bore provided in the advance piston.

3. The advance arrangement as claimed in claim 1, wherein the servo piston is responsive to speed-dependent fuel pressure variations within a servo control chamber, thereby to permit adjustment of the timing in response to engine speed.

4. The advance arrangement as claimed in claim 1, including a light load arrangement which is responsive to load-dependent fuel pressure variations within a light load control chamber, thereby to permit adjustment of the timing in response to engine load.

5. The advance arrangement as claimed in claim 4, wherein the light load arrangement includes a light load piston moveable relative to the advance piston against the action of a light load control spring in response to load-dependent fuel pressure variations within the light load control chamber.

6. The advance arrangement as claimed in claim 2, wherein a flow route out of the main advance control chamber when the servo piston uncovers the drain port includes a first flat or groove formed on the advance piston and a second flat or groove formed in a surface of the first bore.

7. The advance arrangement as claimed in claim 6, wherein the first and second flats overlap when the advance piston is moved in the retard direction through less than the predetermined amount, the first and second flats being spaced apart when the advance piston is moved in the retard direction through more than the predetermined amount.

8. The advance arrangement as claimed in claim 6, wherein a flow route into the main advance control chamber when the servo piston uncovers the supply port includes the first flat or groove provided on the advance piston.

9. The advance arrangement as claimed in claim 6, wherein the supply port is defined at one end of a first radially extending passage formed in the advance piston, the other end of the first radially extending passage being in communication with the first flat or groove on the advance piston.

10. The advance arrangement as claimed in claim 6, wherein the drain port is defined by one end of a second radially extending passage formed in the advance piston, the other end of the second radially extending passage being in communication with the second flat on the surface of the first bore.

11. The advance arrangement as claimed in claim 10, wherein the supply port and the drain port open into the second bore provided in the advance piston at angularly spaced locations.

12. The advance arrangement as claimed in claim 2, wherein the restricted flow path is defined by a restricted clearance between an outer surface of the advance piston and the surface of the first bore when the advance piston is moved in the retard direction through more than the predetermined amount.

13. The advance arrangement as claimed in claim 1, wherein the predetermined amount is between about 4 and 8 degrees of retardation of the advance piston.

14. The advance arrangement as claimed in claim 1, wherein the advance piston is cooperable with a cam arrangement of the fuel pump to advance or retard the timing of fuel pump delivery.

15. An advance arrangement for controlling timing of fuel delivery by a fuel pump for use in an engine, the advance arrangement comprising;

an advance piston which is movable in either an advance or a retard direction to advance or retard, respectively, the timing of fuel pump delivery, the advance piston being exposed, at one end, to fuel pressure within a main advance control chamber, the advance piston having a supply port to allow fuel to flow into the main advance control chamber and a drain port to allow fuel to flow out of the main advance control chamber, a servo piston which is movable relative to the advance piston in response to speed-dependent fuel pressure variations within a servo control chamber to control opening and closing of the supply port and the drain port, thereby to permit adjustment of the timing in response to engine speed, a light load arrangement which is movable in response to load-dependent fuel pressure variations within a light load control chamber, thereby to permit adjustment of the timing in response to engine load, and a restricted flow path for restricting the flow of fuel out of the main advance control chamber through the drain port when the drain port is opened by the servo piston and the advance piston moves in the retard direction beyond a threshold amount.

16. The advance arrangement as claimed in claim 15, wherein the light load arrangement includes a light load piston moveable relative to the advance piston against the action of a light load control spring in response to load-dependent fuel pressure variations within the light load control chamber.

17. The advance arrangement as claimed in claim 15, wherein a flow route out of the main advance control chamber when the servo piston uncovers the drain port includes a first flat or groove formed on the advance piston and a second flat or groove formed in a surface of a bore within which the advance piston moves.

18. The advance arrangement as claimed in claim 17, wherein the first and second flats overlap when the advance piston is moved in the retard direction through less than the threshold amount, the first and second flats being spaced apart when the advance piston is moved in the retard direction through more than the threshold amount.

19. The advance arrangement as claimed in claim 17, wherein a flow route into the main advance control chamber when the servo piston uncovers the supply port includes the firs flat or groove provided on the advance piston.

20. The advance arrangement as claimed in claim 17, wherein the restricted flow path is defined by a restricted clearance between an outer surface of the advance piston and the surface of the bore when the advance piston is moved in the retard direction through more than the threshold amount.

21. The advance arrangement as claimed in claim 15, wherein the threshold amount is between about 4 and 8 degrees of retardation of the advance piston.

* * * * *